US010755681B2

(12) United States Patent
May

(10) Patent No.: US 10,755,681 B2
(45) Date of Patent: Aug. 25, 2020

(54) INSTRUMENT CARRIER WITH AUTO-RELEASE ARTICULATING BACK BRACE

(71) Applicant: Randall May International Inc., Irvine, CA (US)

(72) Inventor: Randall L. May, Irvine, CA (US)

(73) Assignee: Randall May International, Inc., Irvine, CA (US)

( * ) Notice: Subject to any disclaimer, the term of this patent is extended or adjusted under 35 U.S.C. 154(b) by 0 days.

(21) Appl. No.: 16/283,259

(22) Filed: Feb. 22, 2019

(65) Prior Publication Data

US 2019/0189094 A1 Jun. 20, 2019

Related U.S. Application Data

(63) Continuation of application No. PCT/US2017/048238, filed on Aug. 23, 2017.

(60) Provisional application No. 62/378,585, filed on Aug. 23, 2016.

(51) Int. Cl.

| | |
|---|---|
| ***G10D 13/00*** | (2020.01) |
| ***G10D 13/10*** | (2020.01) |
| ***A45F 3/10*** | (2006.01) |
| ***G10G 5/00*** | (2006.01) |
| *G10D 13/02* | (2020.01) |

(52) U.S. Cl.

CPC ..... *G10D 13/28* (2020.02); *A45F 3/10* (2013.01); *G10D 13/00* (2013.01); *G10G 5/005* (2013.01); *G10D 13/02* (2013.01)

(58) Field of Classification Search

CPC ..... G10D 13/026; G10D 13/00; G10D 13/02; G10G 5/005; A45F 3/10

See application file for complete search history.

(56) References Cited

U.S. PATENT DOCUMENTS

| | | | | |
|---|---|---|---|---|
| 4,453,442 | A | 6/1984 | LaFlame | |
| 4,643,032 | A | 2/1987 | Lawrenz et al. | |
| 4,799,610 | A | 1/1989 | Hseih | |
| 5,400,683 | A * | 3/1995 | LaFlame | G10G 5/005 224/265 |
| 5,691,492 | A | 11/1997 | May | |
| 6,028,257 | A | 2/2000 | May | |
| 6,172,290 | B1 | 1/2001 | May | |
| 6,323,407 | B1 | 11/2001 | May | |
| 6,329,583 | B1 | 12/2001 | May | |
| 6,403,869 | B2 | 6/2002 | May | |
| 6,770,805 | B2 | 8/2004 | May | |
| 6,881,886 | B2 | 4/2005 | May | |

(Continued)

FOREIGN PATENT DOCUMENTS

GB 2 123 676 A 2/1984

OTHER PUBLICATIONS

PCT/US2017/048238, International Preliminary Report on Patentability (PCT/IB/326 and PCT/IB/373) dated Mar. 7, 2019 (Seven (7) pages).

*Primary Examiner* — Kimberly R Lockett

(74) *Attorney, Agent, or Firm* — Crowell & Moring LLP

(57) ABSTRACT

A shoulder supported carrier structure has an articulable back brace with an auto-release feature. The auto-release feature allows for the back brace to translate towards/away from shoulder supports of the carrier structure so as to permit better positioning of the carrier structure on a user, as well as easier mounting and removal.

13 Claims, 20 Drawing Sheets

(56) References Cited

U.S. PATENT DOCUMENTS

| | | | |
|---|---|---|---|
| 7,071,401 | B2 | 7/2006 | May |
| 2005/0040193 | A1 | 2/2005 | May |
| 2005/0103183 | A1 | 5/2005 | May |
| 2005/0183565 | A1 | 8/2005 | May |
| 2006/0096443 | A1 | 5/2006 | May |
| 2013/0133505 | A1 | 5/2013 | Momose |

* cited by examiner

INSTRUMENT CARRIER WITH AUTO-RELEASE ARTICULATING BACK BRACE

CROSS REFERENCE TO RELATED APPLICATION

This application is a continuation of PCT International Application No. PCT/US2017/048238, filed Aug. 23, 2017, which is related to application Ser. No. 13/528,337, filed on Jun. 20, 2012, provisional application 61/500,961, filed on Jun. 24, 2011, provisional application 62/241,908, filed on Oct. 15, 2015, and which claims the benefit of provisional application 62/378,585, filed on Aug. 23, 2016, the entire contents of which are hereby expressly incorporated by reference herein.

BACKGROUND OF THE INVENTION

The disclosure relates to a shoulder mounted percussion instrument carrier for one or more drums or other equipment. In particular, the disclosure relates to shoulder mounted carriers having articulating back supports. More particularly, the disclosure relates to structures and methods by which the mounting, positioning and release of such articulating back supports with respect to a user are improved.

The prior art discloses examples of carriers supporting one or more drums or equipment items (e.g., cameras).

La Flame U.S. Pat. No. 5,400,683 discloses a carrier for percussion instruments having an abdominal plate connected at one end of a unitary frame partly encircling the wearer at the waist and having an upstanding rear portion pivotally connected to a back pressure plate. Shoulder bars are connected to the back-pressure plate and wrap about shoulders and support straps connect to the abdominal plate.

Hsieh U.S. Pat. No. 4,799,610 shows a carrier for percussion instruments having a "T" bar, a pair of shoulder bars, and a belly plate. The shoulder bars are bolted on a lateral plate of the "T" bar. The lateral plate has arc-like slots and spaced semi-circular holes permit bolts to slide in the slots. The fastening end of each shoulder bar has a hole and an arc-like slot from the upper portion to the lower portion permitting angular adjustment of the shoulder rightward or leftward for various applications.

La Flame U.S. Pat. No. 4,643,032 shows a carrier for various instruments such as marching bells, a marching xylophone or a marching marimba, which are supported on the apparatus by the use of suitably-constructed extension arms. The carrier frame is a U-shaped bent bar welded or otherwise attached to a belly plate and has extension arms, which project from the belly plate to engage and support the instrument.

La Flame GB Patent 2,123,676 (based on U.S. Pat. No. 4,453,442) discloses a carrier for percussion instruments or the like which includes the combination of a belly plate with a carrier bracket for supporting an instrument at an outwardly-overhung position about a fulcrum area of contact with the front waistline area of the person, a rigid band with a generally bent contour to extend along a portion of the waistline area of the person to the back of the person, a back-plate riser arm supported by the ban to extend in a generally upward direction such that a portion of the arm will extend along the back thoracic region of the person, and means carried by the arm for imparting to the thoracic back region of the person a reactive force to the overhung weight of the instrument about the aforesaid means forming a fulcrum area of contact with the person.

The inventor has been issued several patents and has filed several patent applications covering other such carriers, including U.S. Pat. Nos. 5,691,492, 6,028,257, 6,323,407, 6,329,583, 6,172,290, 6,403,869, 6,770,805, 6,881,886, 7,071,401, and U.S. published applications US2005/0040,193, US2006/0096,443, US2005/0103,183 and US2005/0183,565. None of these patents or patent applications disclose the carrier structure described herein.

BRIEF SUMMARY OF THE INVENTION

It is an object of the shoulder mounted apparatus to provide a carrier that allows a user to carry and use equipment or play drums while they transport the equipment or drums such as when they are walking, marching, rapidly moving and at times running. The mounting allows for the equipment or drum(s) to be maintained in a horizontal or rotated vertical orientation where a camera or drumheads are oriented in a horizontal configuration allowing the equipment or drum to be used or played.

It is another object of the carrier to include a connecting member that spans between the shoulder supporting members behind the user or performer. The connecting member is joined to an arm that is connected to a back member that allows the back member to pivot and translate relative to the two shoulder supporting members to allow the back member to align with a back of a user. The connecting member may be joined to the one arm with a frictional connection. The arm may be connected to the back member with a frictional connection. The back member at least partially contours to the shape of the back and may further include an inflatable cushioning bladder and is positioned between and under or evades the shoulder blades of the user to increase arm mobility.

It is still another object of the carrier to integrate the two sets of dovetailed sliders is a parallel arrangement to allow the drums to be easily raised and lower on the carrier in a linear sliding arrangement It is still another object of the carrier to utilize a slotted connection between the carrier and the back member that allows the back member to slide on the carrier to allow a performer to easily lift the carrier over their head.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

Figure 11A:
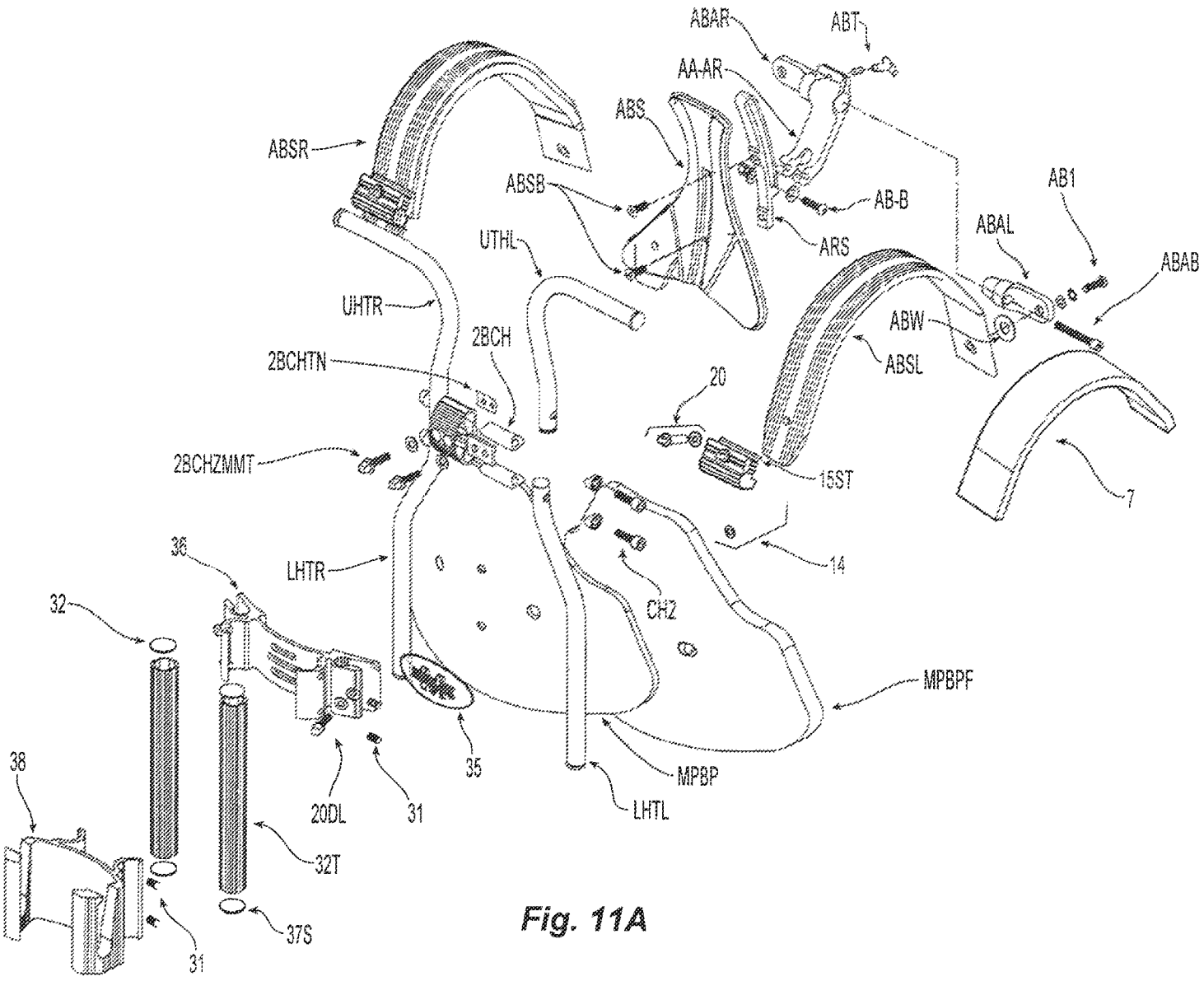
Figure 11B:
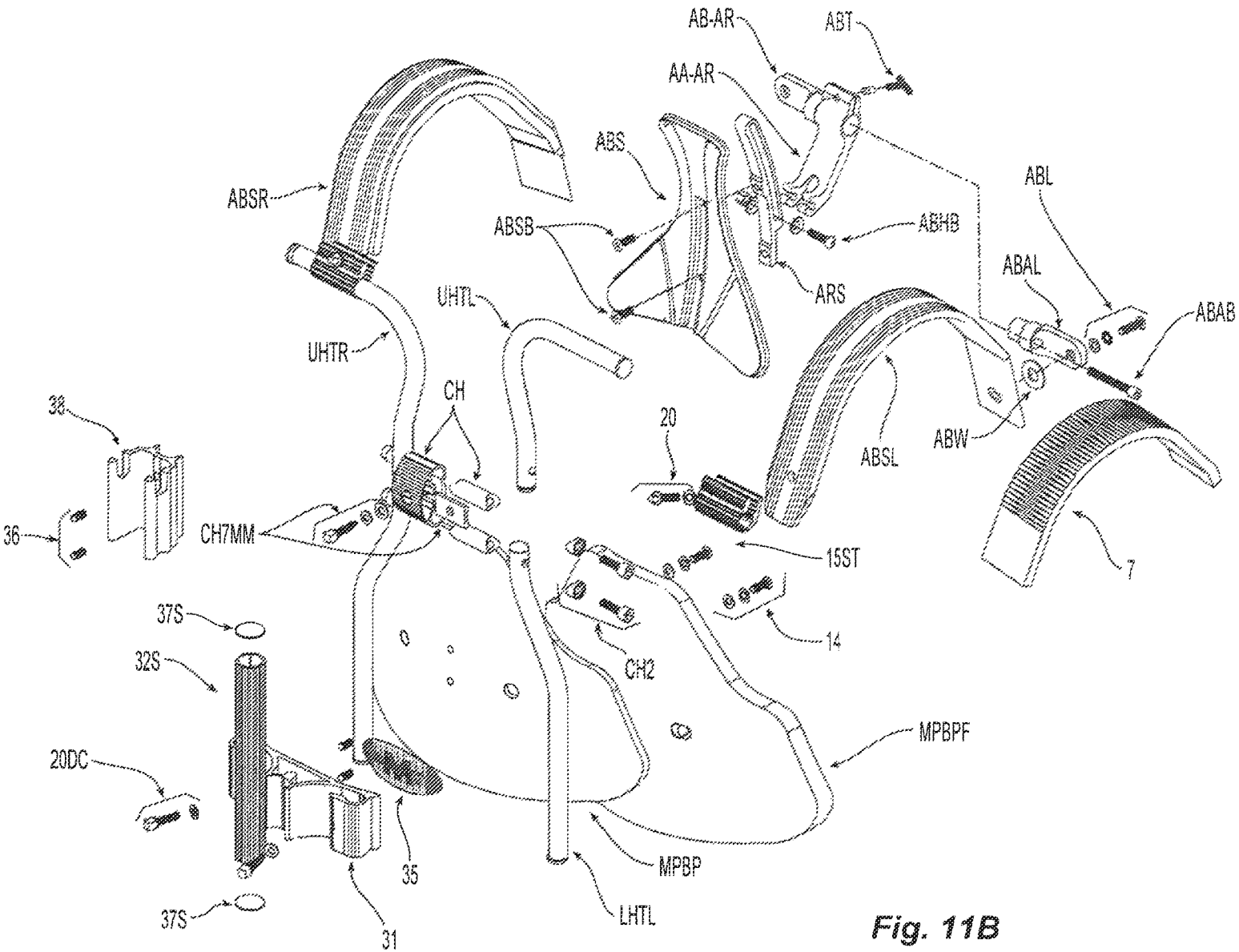
Figure 11C:
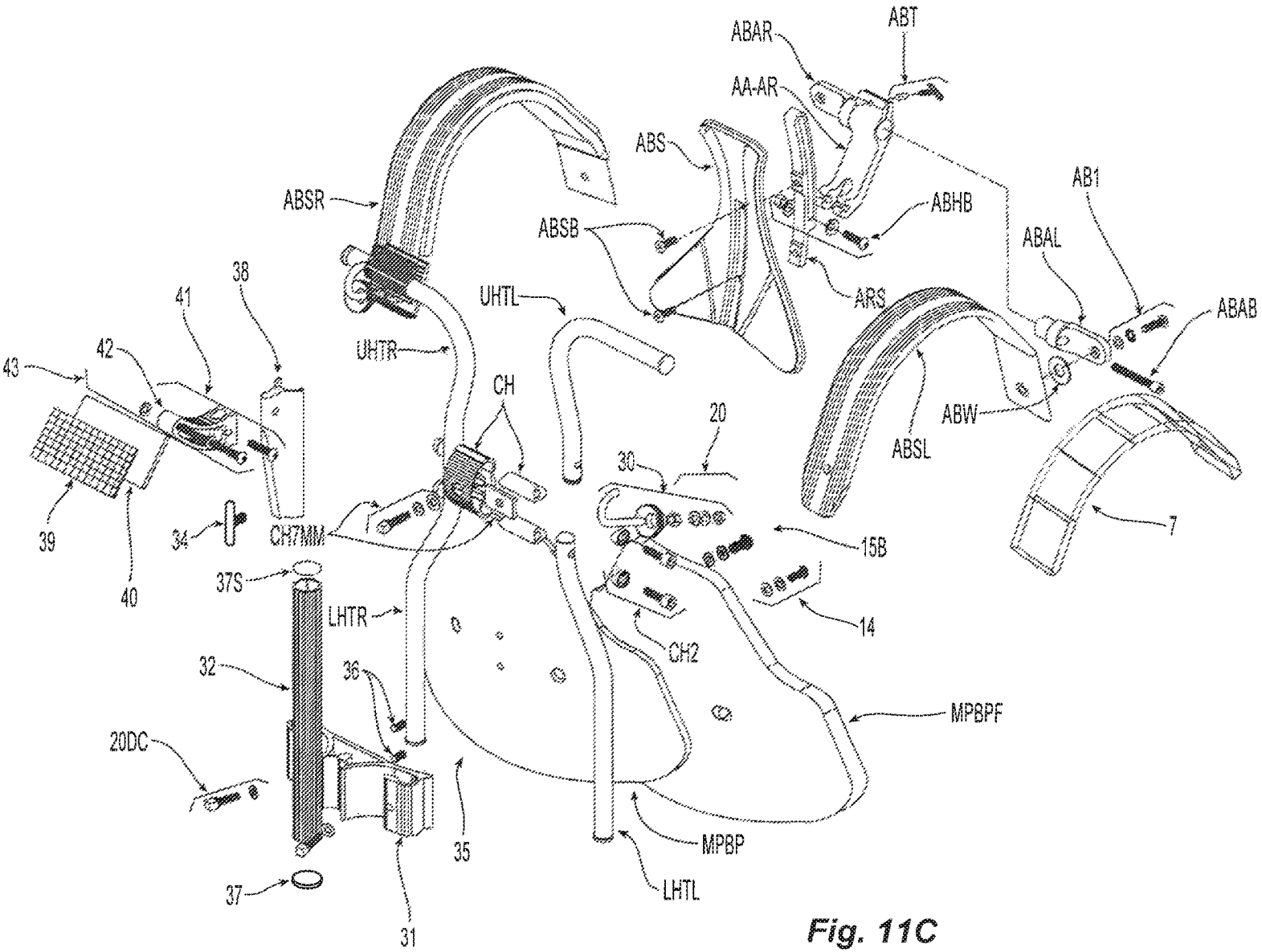

FIGS. 11A-C illustrate exploded views of a plurality of embodiments of the described invention.

Figure 12A:
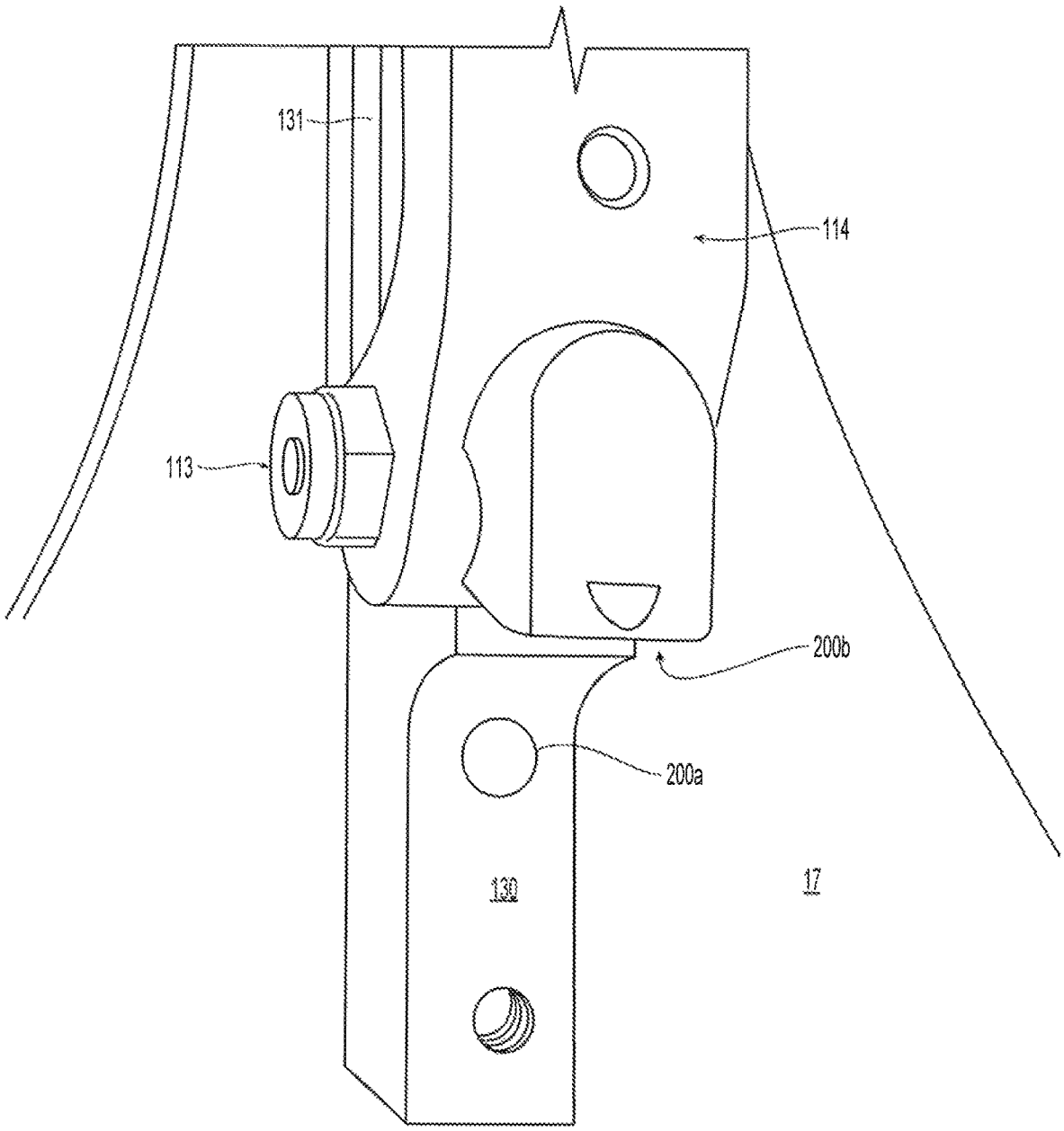
Figure 12B:
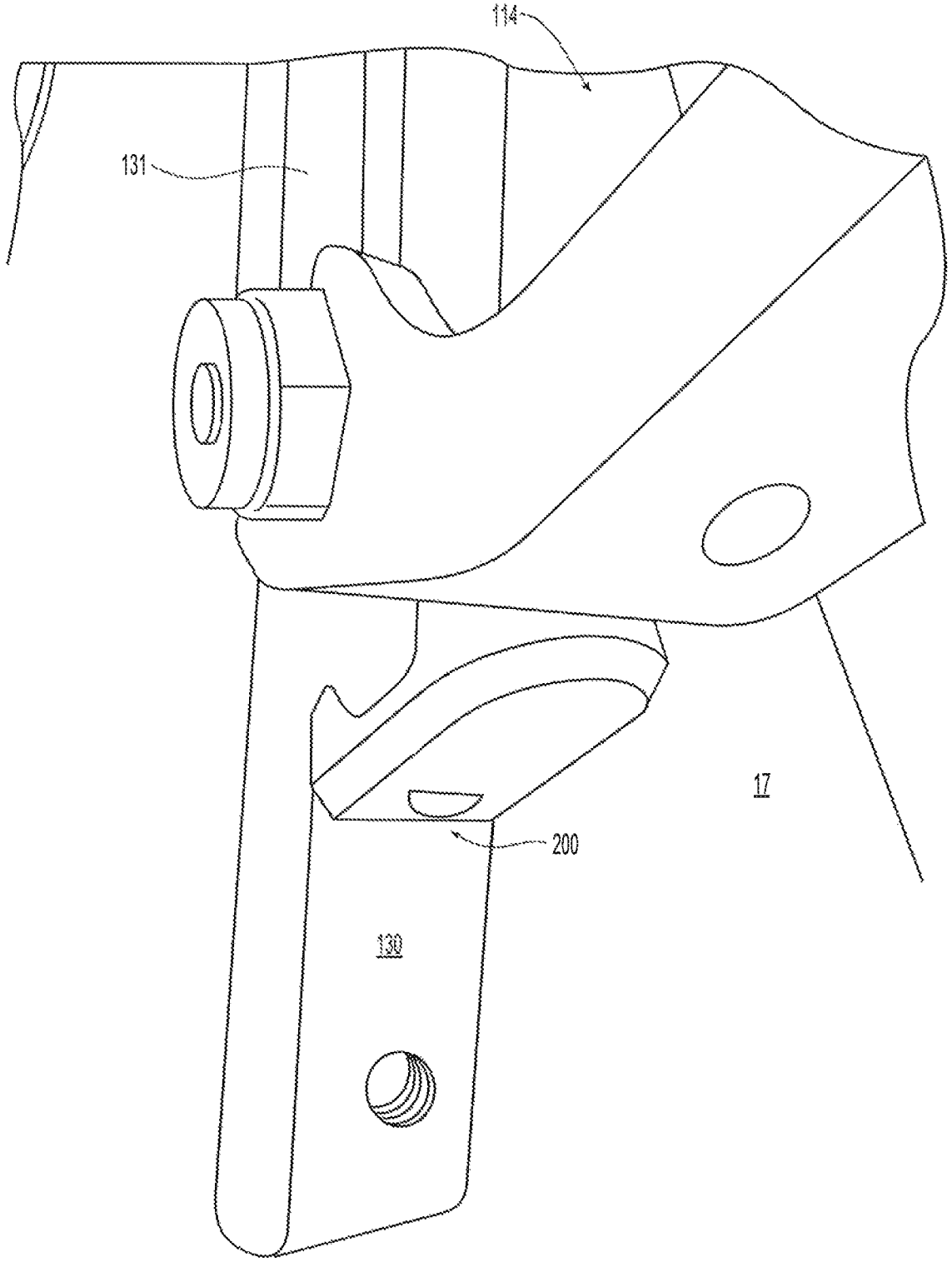
Figure 13A:
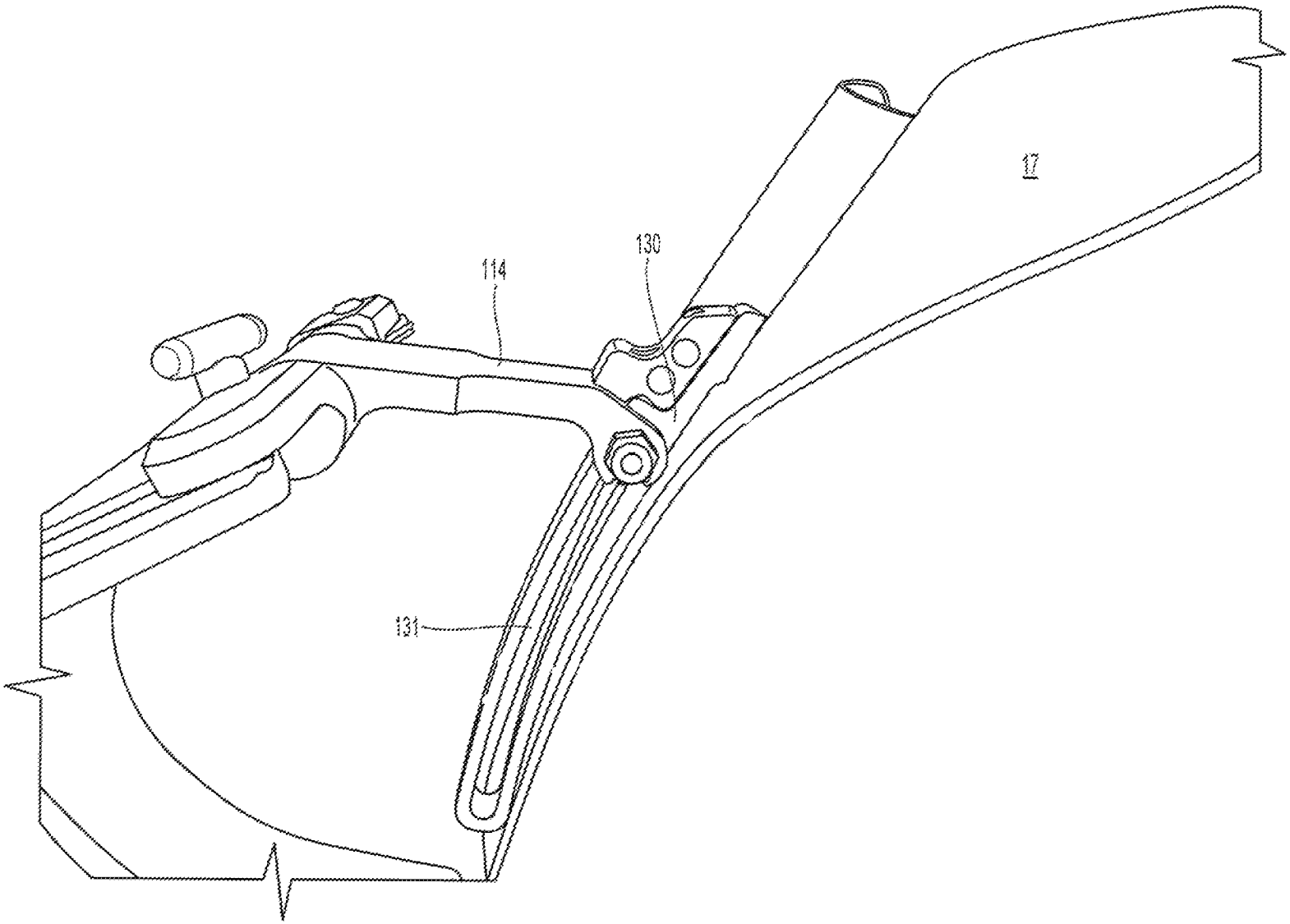
Figure 13B:
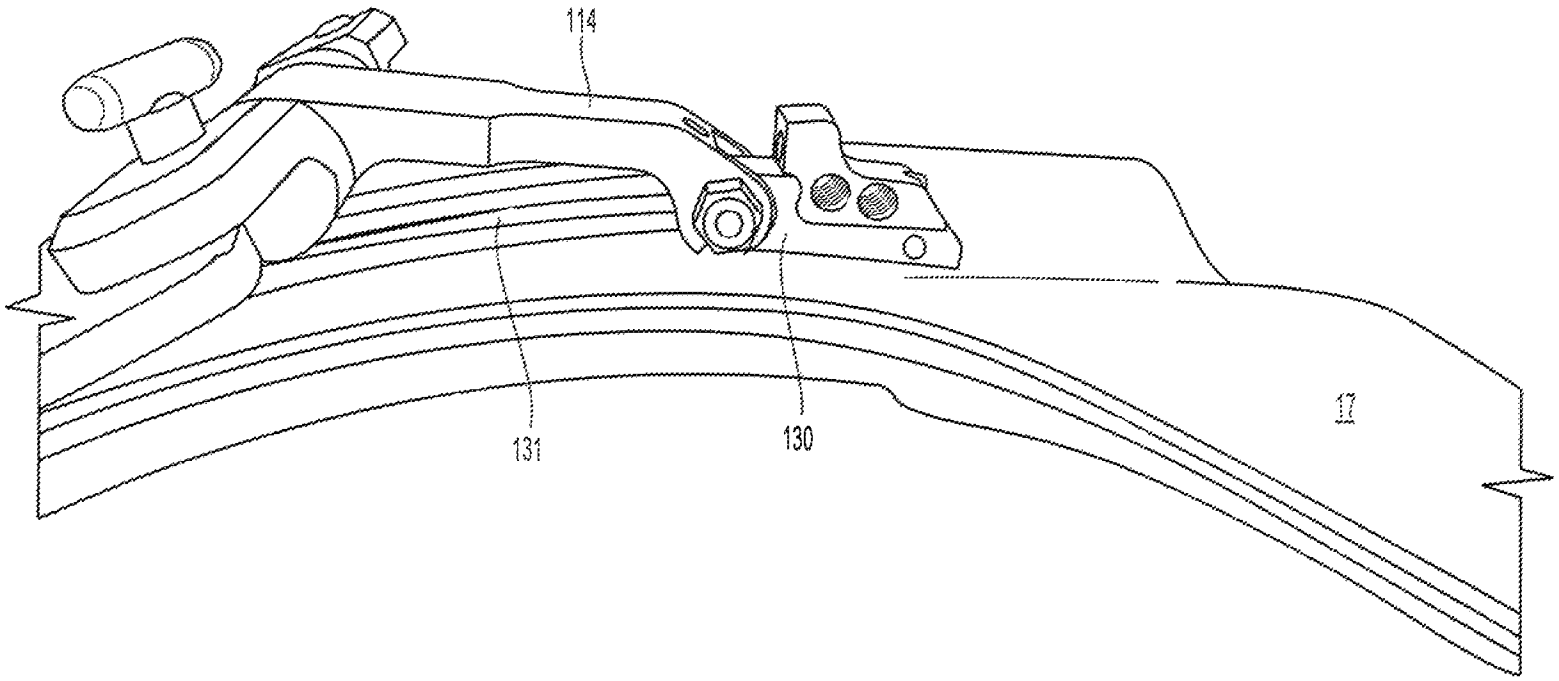
Figure 13C:
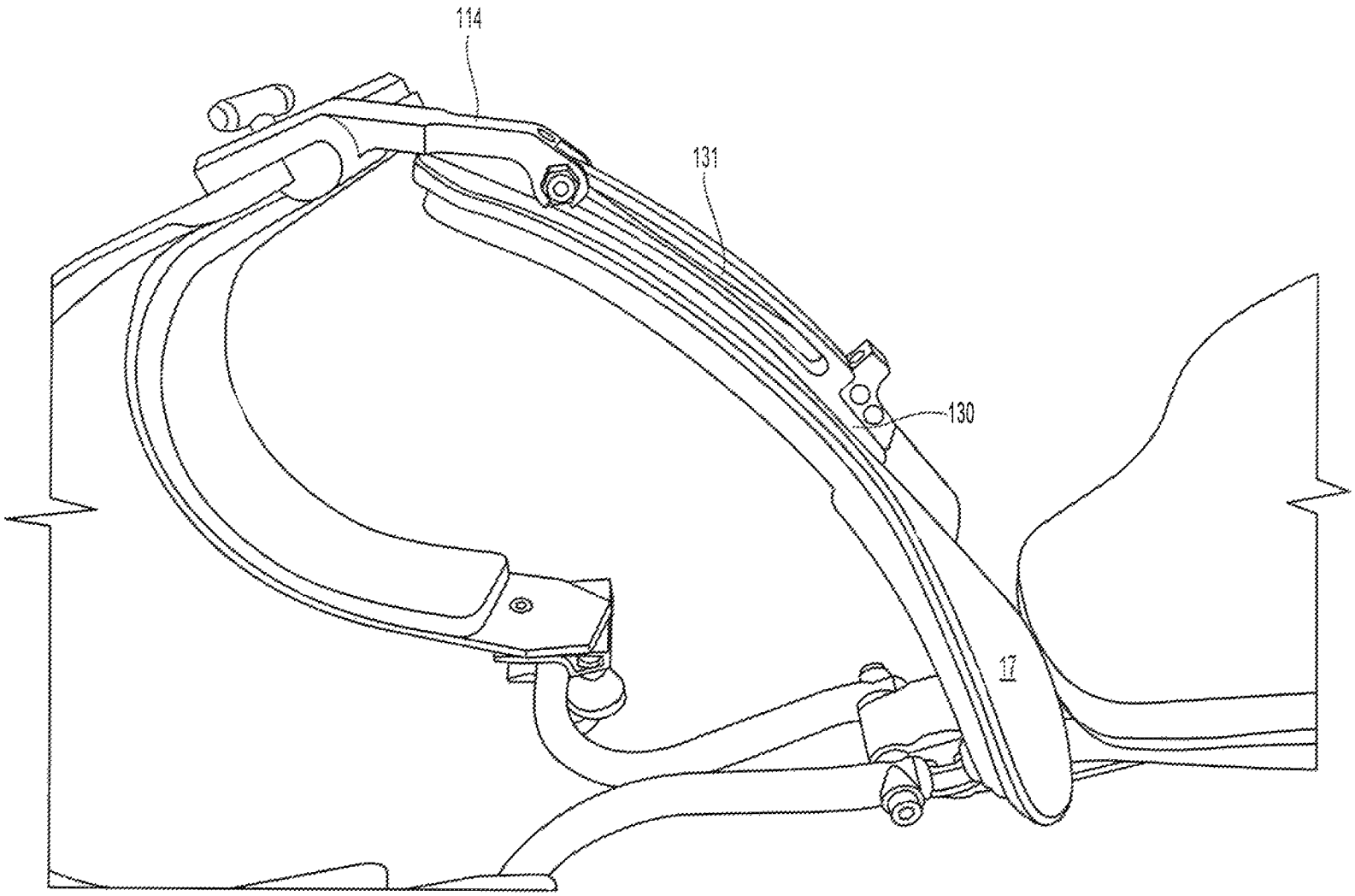
Figure 13D:
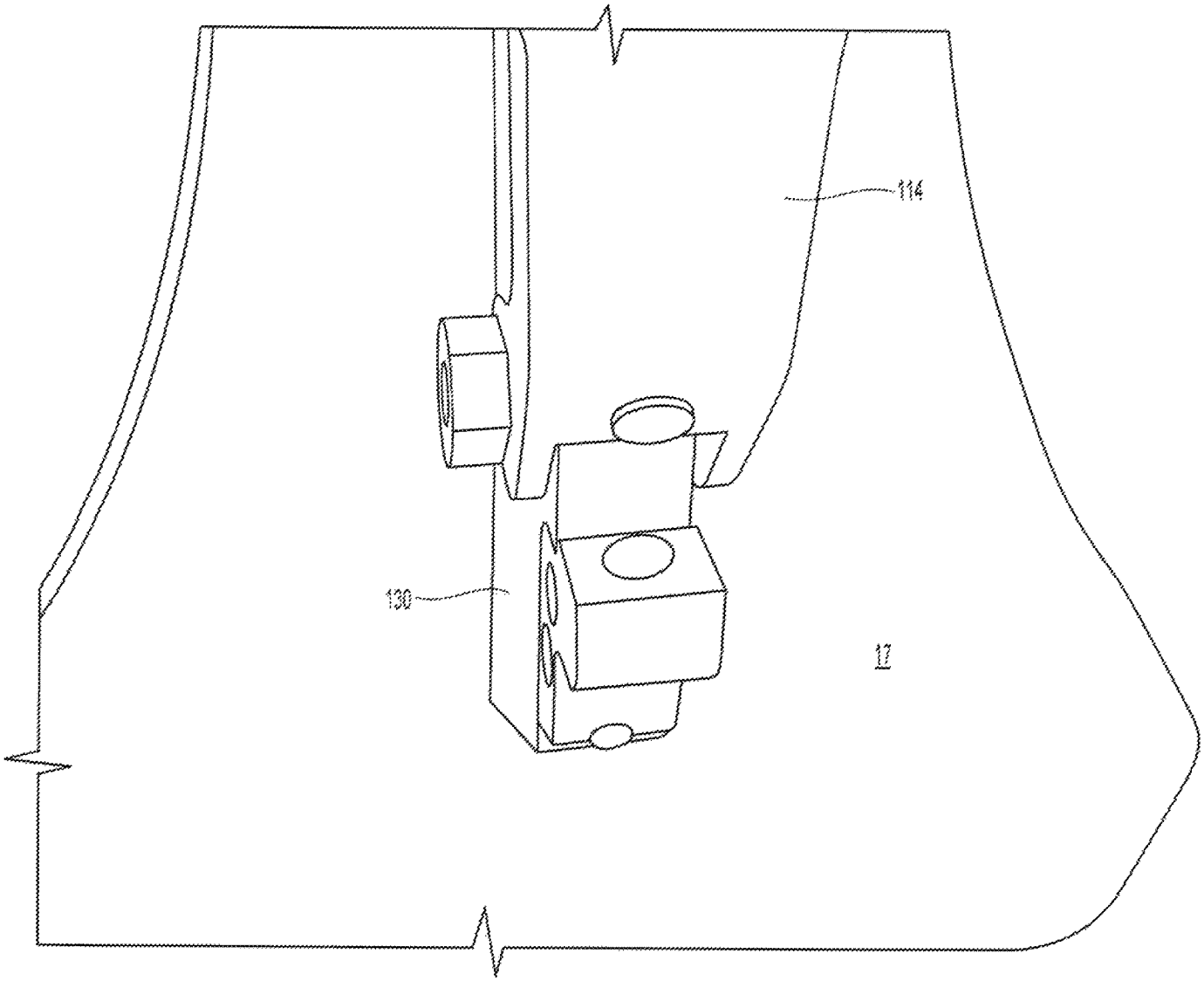

FIGS. 12A-B illustrate close-up views of the described auto-released back support according to one or more embodiments.

FIGS. 13A-D illustrate further close-up views of the described auto-released back support according to one or more embodiments.

FIGS. 14A-D illustrate methods for operating one or more embodiments of the described invention.

DETAILED DESCRIPTION OF THE INVENTION

The above described drawing figures illustrate the described invention and method of use in at least one embodiment, which is further defined in detail in the following description. Those having ordinary skill in the art may be able to make alterations and modifications to what is described herein without departing from its spirit and scope. While this invention is susceptible of embodiment in many different forms, there is shown in the drawings and will herein be described in detail at least one embodiment of the invention with the understanding that the present disclosure is to be considered as an exemplification of the principles of the invention and is not intended to limit the broad aspect of the invention to the at least one embodiment illustrated. Therefore, it should be understood that what is illustrated is set forth only for the purposes of example and should not be taken as a limitation on the scope of the present apparatus and its method of use.

Figure 1:
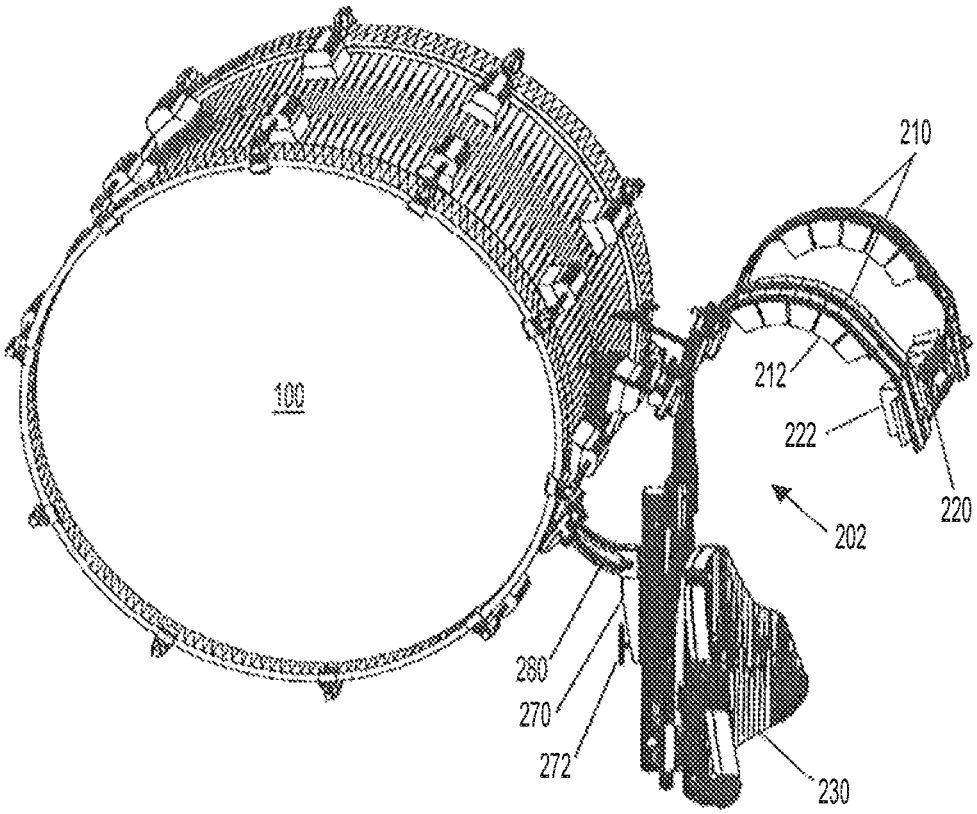
FIG. 1 is an isometric view of an instrument carrier with a bass drum attached.

FIG. 1 is an isometric view of an instrument carrier 202 with a bass drum 100 attached. The carrier 202 is shown as an instrument carrier of tubular construction. In a preferred embodiment, the carrier 202 is of tubular construction, but the carrier 202 can be a type of T-bar, vest, a combination of the types listed above or another configuration that is capable of retaining the mounting components to retain the bass drum 100. The carrier 202 may include shoulder straps 210. The shoulder straps 210 may have padding 212 placed in the area that makes contact with the shoulders of a user. The padding 212 provides a cushioning of the shoulder straps to improve the comfort when a user (or performer) is using the carrier 202 with the bass drum 100. The shoulder straps 210 may be adjustable and/or removable to better fit the size of the user. The carrier 202 may have a back member 220 attached to the free ends of the carrier 202. The back member 220 may be adjustable and/or removably attachable to the carrier 202. The back member 220 may also have padding 222 attached to the side of the back member 220 that makes contact with the user. The shoulder straps 210 may attach to the front portion of the carrier 202. The front of the carrier 202 extends down in front of the user and connects to a belly plate 230. The belly plate 230 curves slightly to wrap around the frontal area of the user and provide a greater contact area. The side of the belly plate 230 that makes contact with the user may also be padded to provide comfort to the user. In the area where the shoulder straps 210 connect to the front of the carrier 202, a connection device may be provided for attachment of the bass drum 100. This is best viewed in FIG. 2 that shows an exploded view of the carrier 202 and attachment components.

Figure 2:
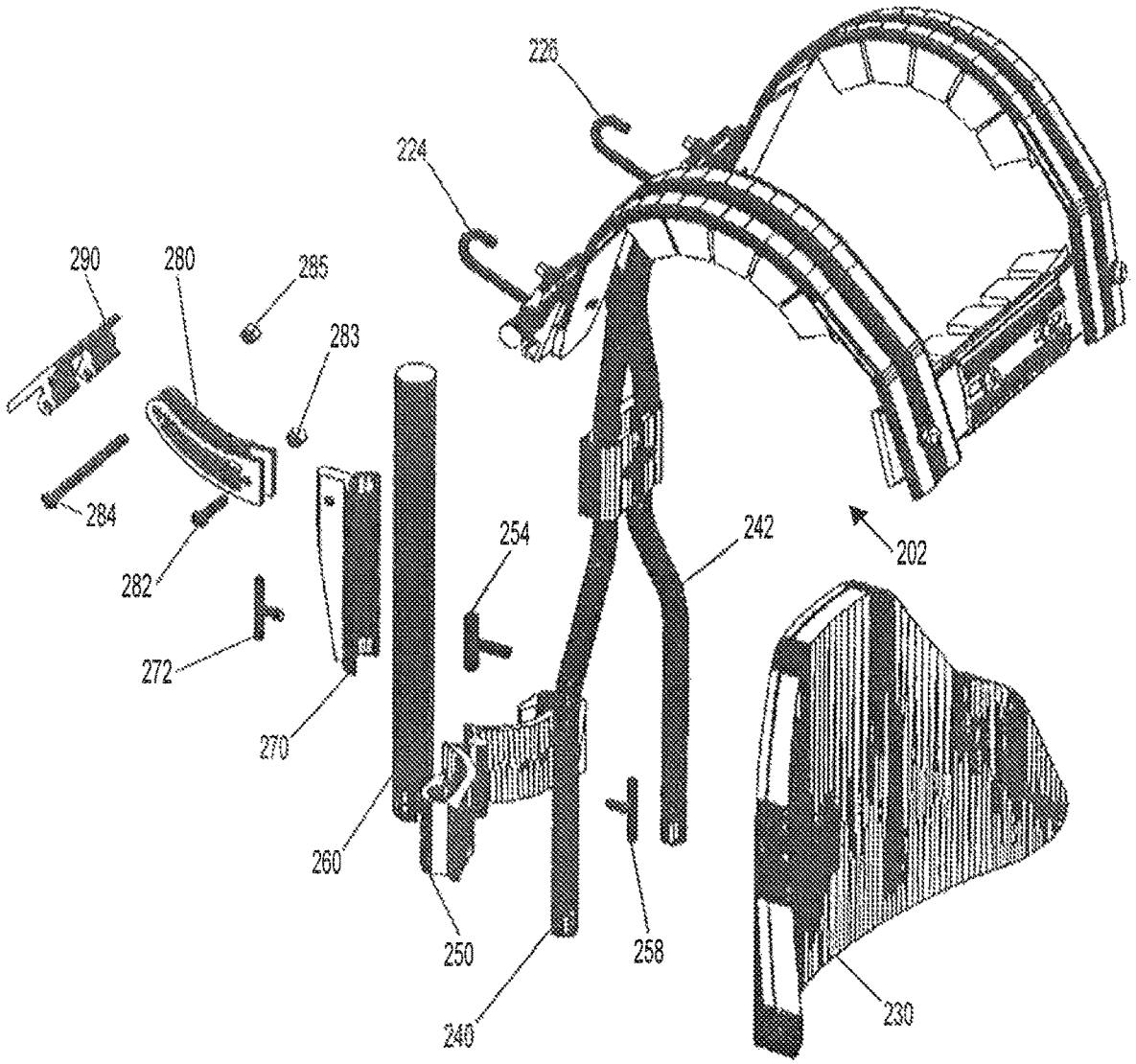
FIG. 2 is an exploded isometric view of the carrier showing the components of the carrier.

In FIG. 2, the carrier 202 is shown as a complete assembly with the belly plate 230 not being connected to the carrier 202. The belly plate 230 is not attached in this figure to show that the belly plate 230 can be adjusted up or down to accommodate users of different sizes. In a preferred embodiment, at least one attachment mechanism such as a J-bolt or a similarly shaped device 224, 226 is provided. The length of the J-bolts 224, 226 can be varied by replacing the J-bolts 224, 226 with longer or shorter J-bolts or by threading the J-bolts 224, 226 into the carrier 202 to different depths. It is further contemplated that J-bolts of different lengths can be used to tip the drum to one side or the other to accommodate the preference of the user. The belly plate 230 can also be replaced with a belly plate of different size and/or shape to accommodate the different sizes of users. In a preferred embodiment, the belly plate 230 is attached to the carrier 202 of tubular construction using a fastening means such as a threaded fastener. The threaded fastener attaches the belly plate 230 to the carrier 202 through holes or slots located in the tubes 240, 242 of the carrier 202. If the attachment of the belly plate 230 is via holes, the belly plate 230 can be adjustably positioned in finite increments where the holes are located on the tubes 240, 242. If the attachment of the belly plate 230 is via slots, the belly plate 230 can be loosened on the tubes 240, 242 and slid into an infinite number of positions to accommodate users of various sizes. On the opposite side of the tubes 240, 242 of the carrier 202, a lift base 250 forms a bridge between the tubes 240 and 242 of the carrier 202. The lift base 250 has two semi-circular openings on each end where the tubes 240, 242 of the carrier 202 pass through. The lift base 250 is attached to the tubes 240, 242 of the carrier 202 using a threaded fastener 254 that clamps the lift base 250 onto the tube(s) 240, 242. The lift base 250 can slide on the tubes 240, 242 of the carrier 202 to locate or position the lift base 250 on the carrier 202.

A tube 260 slides into the center portion of the lift base 250. Two slots run lengthwise down the sides of the tube 260. These slots provide a guide and a retaining mechanism for the tube 260 on the lift base 250. The tube 260 can slide and be locked into a position on the lift base 250 using a fastening means such as a threaded fastener 258. A bass drum support slider 270 is also attached to and slides in the slots that exist on the side of tube 260. The bass drum support slider 270 can be moved on the tube 260, and locked into a fixed position on the tube 260 using a fastening means such as a threaded fastener 272. The bass drum support slider 270 can be placed onto the tube 260 in either orientation based upon where the user wants to orient the remaining pieces of the bass drum support, and where the user wants to position the bass drum 100. A horn-shaped member 280 attaches to the bass drum support slider 270 using a fastening means such as a bolt 282 and a nut 283. Such a fastening means allows the two members 270, 280 to pivot relative to each other and also be locked into a position by tightening the nut 283 onto the bolt 282.

The horn-shaped member 280 can be rotatably adjusted relative to the bass drum support slider 270. Based upon the location of the bass drum support slider 270, and the location of the bass drum 100, the angular relationship between the horn-shaped member 280 and the bass drum support slider 270 is established. At the opposite end of the horn-shaped member 280, a drum support member 290 is provided to support the bass drum 100. The horn-shaped member 280 and the drum support member 290 are connected via a fastening means such as a bolt 284 and a nut 285. Such a fastening means allows the two members 280, 290 to pivot relative to each other and also be locked into a position by tightening the nut 285 onto the bolt 284.

On the flat portion of the drum support member 290, a pad or cushion can be attached to reduce movement and damage to the bass drum 100. This provides a cushion to the bass drum 100 if it moves up or down as the user is walking, marching or moving.

The primary function of components 250, 260, 270, 280, 290 is to provide vertical and horizontal positioning of the bass drum 100. This positioning allows the bass drum 100 to be moved up, down, closer and further away from the user. This allows the bass drum 100 to be positioned in various locations and/or orientations for the comfort of the user. These components 250, 260, 270, 280, 290 may provide a single contact point for the bass drum 100. This single contact point is one of three points that make contact with and/or secure the bass drum 100 to the carrier 202. Two remaining contact points are J-bolts 224 and 226.

The bass drum 100 has two eyebolts attached through the shell of the bass drum 100. The bass drum 100 is attached to the J-bolts 224, 226 of the carrier 202 by positioning the eyebolts over the J-bolts 224, 226, and "hooking" the eyebolts onto the J-bolts 224, 226. Once hooked together, the bass drum 100 is rotated down until it comes in contact with the pad on the drum support member 290. The user can slide and position components 250, 260, 270, 280, 290 to locate the bass drum 100 in the playing position that the user prefers.

Figure 3:
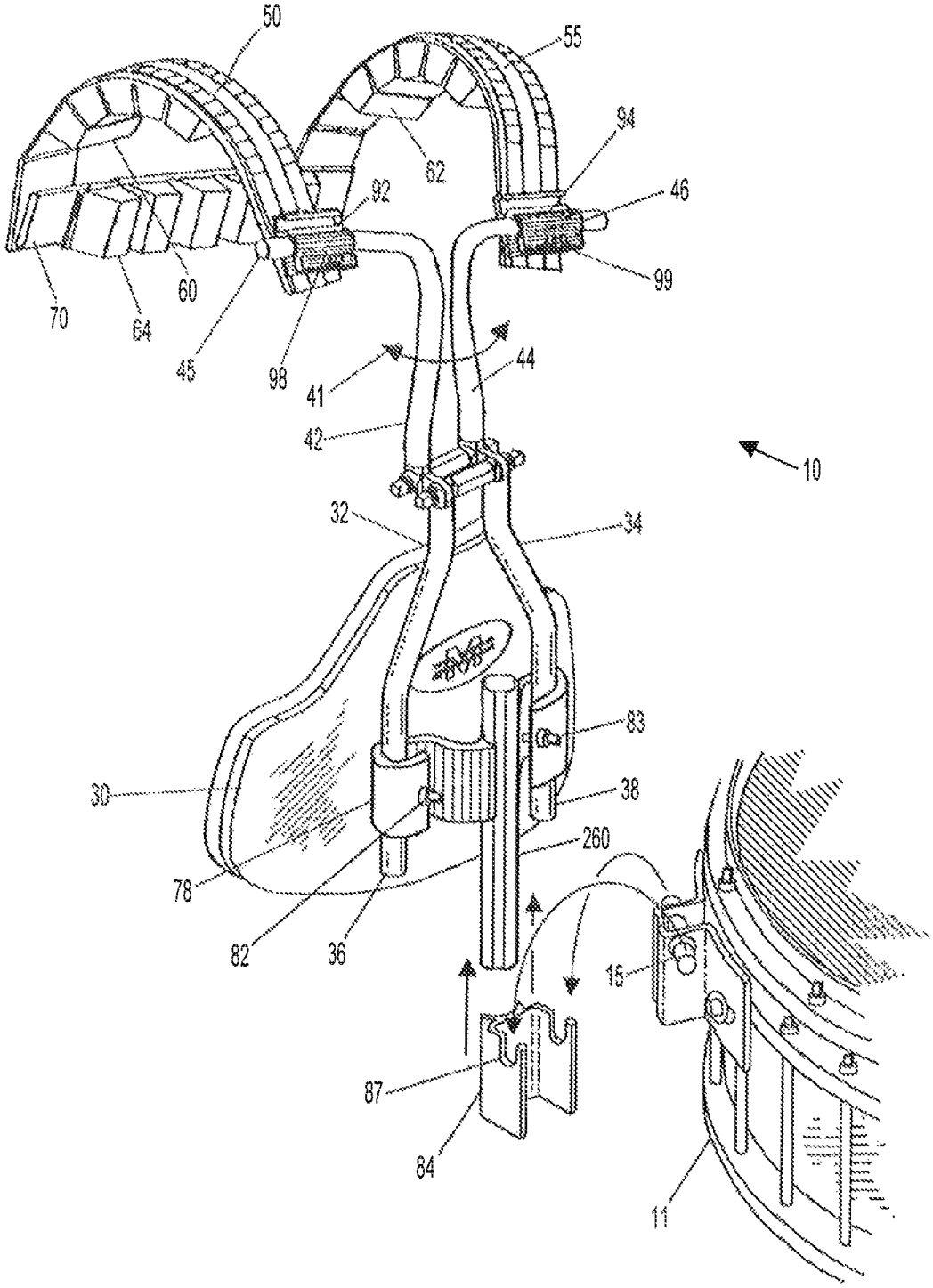
FIG. 3 shows a view of the drum tracking system for use with a single drum.

FIG. 3 shows a view of the drum tracking system for use with a single drum 11. This figure shows a tubular type carrier 10 that is similar in construction to the carrier 202 for percussion instruments shown and described in FIG. 1. The carrier 10 has an abdomen plate 30, with lower body support rods 32, 34. The carrier 10 also has upper body support rods or tubes 42, 44. The upper and lower body support rods or tubes are connected to each other with a retainer that keeps the tubes in a parallel relationship.

The lower body support rods or tubes 32, 34 independently spread to parallel portions 36, 38 where they attach to the supporting abdomen plate 30. The upper body support rods or tubes 42, 44 having out-turned portions 45, 46 supporting rigid shoulder straps 50, 55 and a back bar 70. The back bar 70 may be removably secured to the shoulder straps 50, 55 or may be fixedly attached by welding or the like. The shoulder straps 50, 55 and back bar 70 may have cushions 60, 62 and 64. The cushions 60, 62 and 64 may be of a type used to pad the interior of football and other sports helmets and are shown in more detail in U.S. Pat. No. 6,028,257. The cushions 60, 62 and 64 may have a backing strip of polyvinyl plastic film. A thin sheet of polyvinyl film encloses blocks of closed pore plastic (e.g., polystyrene or polyurethane) foam and is sealed to the backing strip to enclose separate blocks which are separately compressible and provide more comfort to the wearer of the carrier when fully loaded.

The abdomen plate 30 is secured to a bridge support member 78 with a pivot that extends through ears on the abdomen plate 30. The placement of the pivot through the center of the bridge support member 78 allows the abdomen plate 30 to rotate by a limited amount on the pivot(s). The pivoting allows the abdomen plate 30 to move with the user without significantly altering the position of the carrier 10 on the user. The pivots can be tightened slightly to provide frictional or limited pivoting as well as loosened to allow for free pivoting. It is also contemplated that the abdomen plate 30 is removably secured to the carrier 10.

Clamping receptacles 92, 94 may be semi-circular receptacles through which the out-turned portions 45, 46 fit. Tightening means 98, 99 clamp the tubes or rods to secure them within the receptacles 92, 94 and prevent movement 41. Clamping receptacles 82, 83 are mounted to the abdomen plate 30, and the tubes 32, 34 can be re-positioned within the receptacles 82, 83. The upper, out-turned portions 45, 46 of the upper body support rods 42, 44 are supported in the clamping receptacles 92 and 94 on the shoulder straps 50 and 55. A single tube or shaft 260 may be used to connect the carrier 10 with the single drum 11 through a sliding cradle 84.

The sliding cradle 84 connects to the single tube or shaft 260 with dovetail grooves. A second set of dovetail grooves exist on the bridge support member 78. The bridge support member 78 has male dovetail grooves that mate with the female dovetail groves in the single tube or shaft 260. A similar set of male dovetail features exist on the sliding cradle 84. These dovetail features are arranged to allow the sliding cradle 84 to slide past the bridge support member 78. The sliding cradle 84 has a recessed cradle 87 for connection with hinge pins 15 of the single drum 11. The hinge pin 15 is secured to the single drum 11 with a rotation hinge plate. The rotation hinge plate and its connection to the single drum 11 is shown and described in more detail in U.S. Pat. Nos. 5,691,492 and 7,326,842, and U.S. Published Application 2009/0045235.

While the embodiment shown in FIG. 3 illustrates a single drum tracking system, the drum tracking system of the present invention is not limited to such a single drum tracking system. In an alternate embodiment, the drum tracking system may be, e.g., a dual tracking system or a multi-tracking system for one or an array of drums of various sizes without departing from the scope of the present invention.

Figure 4:
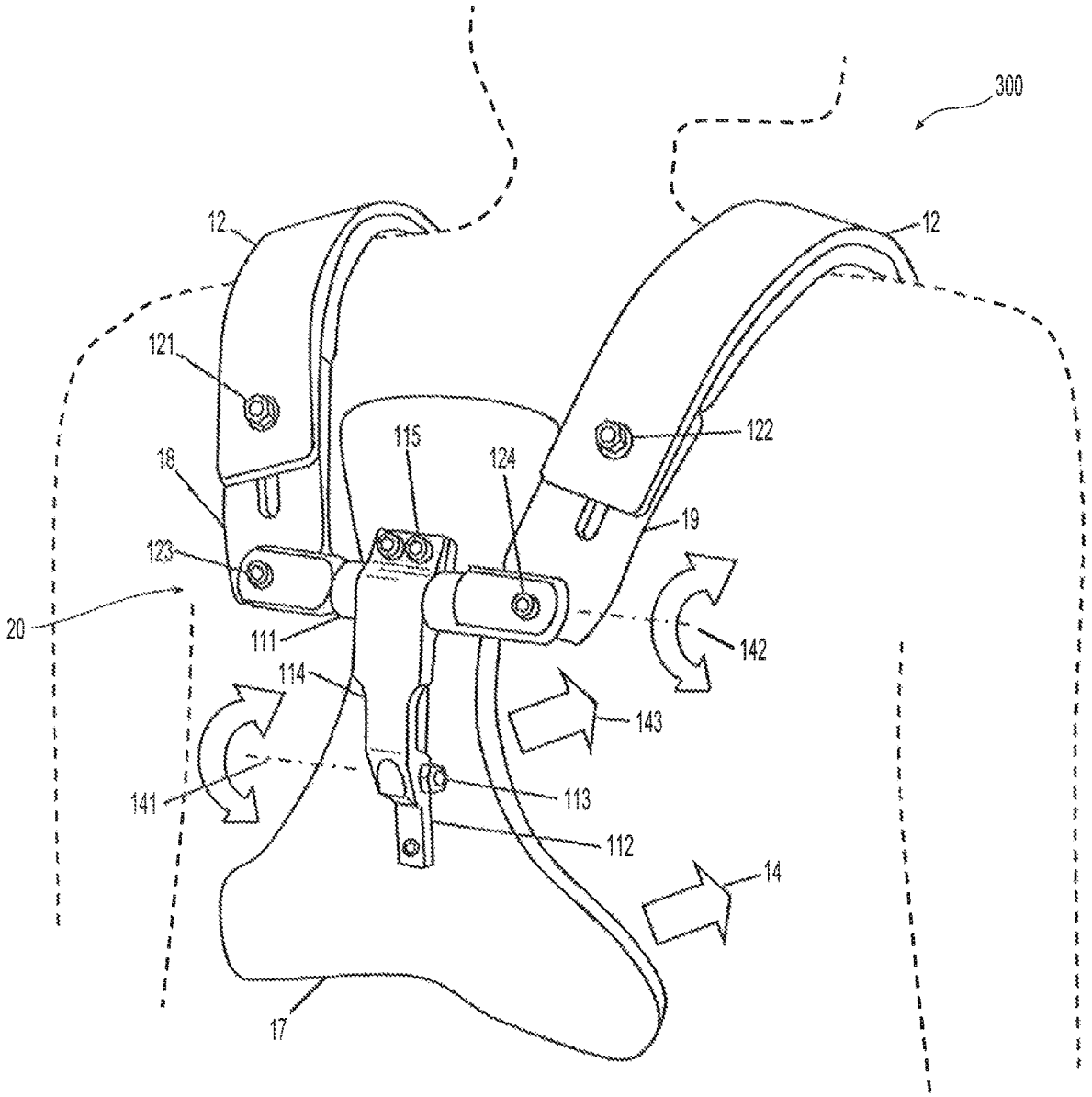
FIG. 4 shows a rear view of a conforming and articulating back member assembly.

FIG. 4 shows a rear view of a conforming and articulating back member assembly 20. The view of the articulating back member 17 is shown mounted on a user (or performer) where the shoulder supports or shoulder straps 12 extend over the shoulders of the user. The shoulder straps 12 may attach to the front portion of a carrier 300, which extends down in front of the user and connects to a belly plate, as described above in reference to FIGS. 2 and 3. The end of the shoulder straps 12 are connected using a fastening means such as bolts 121, 122 to extenders 18, 19. The extender 18, 19 allow for adjustment of the length of the shoulder supports or shoulder straps 12 down the back of the user. Slots or multiple holes may be used to extend the length of the shoulder straps 12. The extenders 18, 19 are connected using a fastening means such as bolts 123, 124 to a horizontal connecting member 111 that connects the two shoulder members 12 and creates a pivoting axis 142 that allows a back member (or back plate) 17 to swing into the user on an arm 114. The bolts 123, 124 can be loosened and repositioned or slid in holes or slots in the horizontal connecting member 111 to change the width and or angle of the shoulder straps 12.

A fastening means such as bolts 115 secures the arm 114 around the horizontal connecting member 111. The bolts 115 can be adjustable to change the frictional resistance for pivotal movement about the pivotal axis 142. The arm 114 pivots about the axis 142 on one end with the horizontal connecting member 111 and on the other end about an axis 141 where the arm 114 is secured, via a fastening means 113, to a bracket 112 that is connected to the back member 17.

The arrangement of the pivoting axes 141, 142 allows the back member 17 to move towards 143 and away from the back of the user to provide an even pressure on the back of the user to more evenly distribute loads that push into the back of the user. The shape of the back member 17 may be contoured to bridge between the shoulder blades thereby reducing restriction of arm movement.

Figure 5:
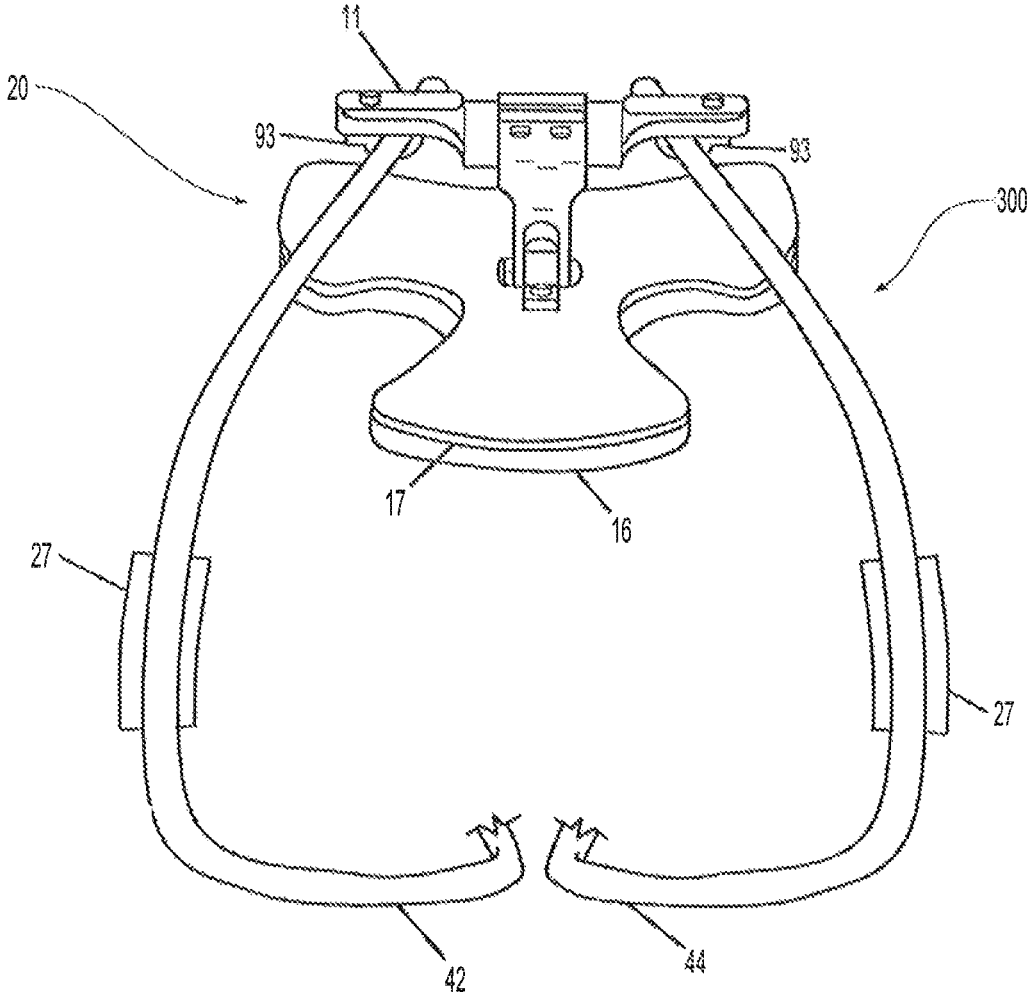
FIG. 5 shows a top view of an instrument carrier.

FIG. 5 shows a top view looking down from the top of the instrument carrier 300 onto the conforming and articulating back member assembly 20. In this figure, portions of the upper body supporting rods 42, 44 are shown as they extend over the shoulder where pads 27 cushion the apex of the shoulders of the user. It is further contemplated that a pivotable connection can exist near the apex of the shoulder pads 27. The head of the performer passes through the open area between the shoulder pads 27. Referring to FIGS. 4 and 5, the shoulder straps 12 is connected with tube clamps 93 which are connected to the horizontal connecting member 111. The position of the back member 17 can be adjusted by changing the position of the tube clamps 93 on the tubes. The pivot arm 114 connects to mounting bracket 112 and into the back member 17. Pad 16 is shown attached to the back member 17. The pad 16 provides a cushion and/or more evenly distributes the load of the back member onto the user's back. It is also contemplated that the rods 42, 44 can be broken and hinged at a point near or a distance from the apex of the shoulders to allow the distance between the front of the carrier 300 and the back member 17 to be adjusted.

Figure 7:
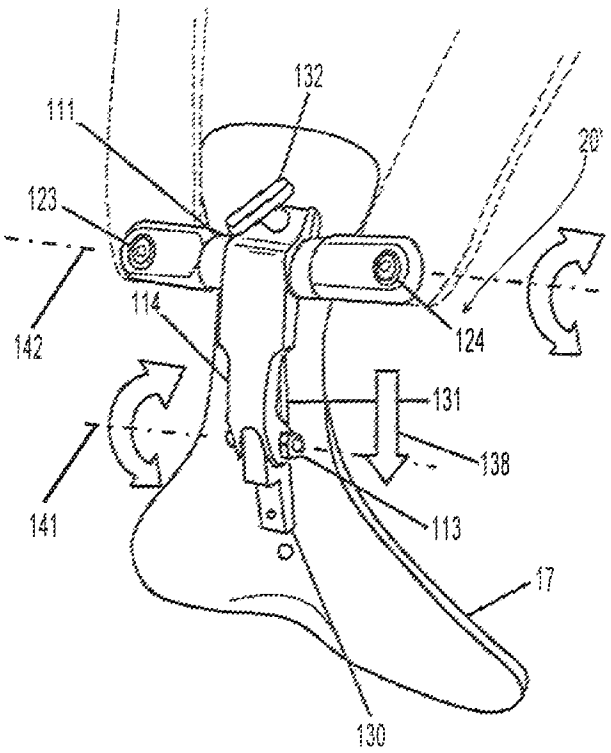
FIG. 7 shows the embodiment from FIG. 6 with the back member in a top position.
Figure 6:
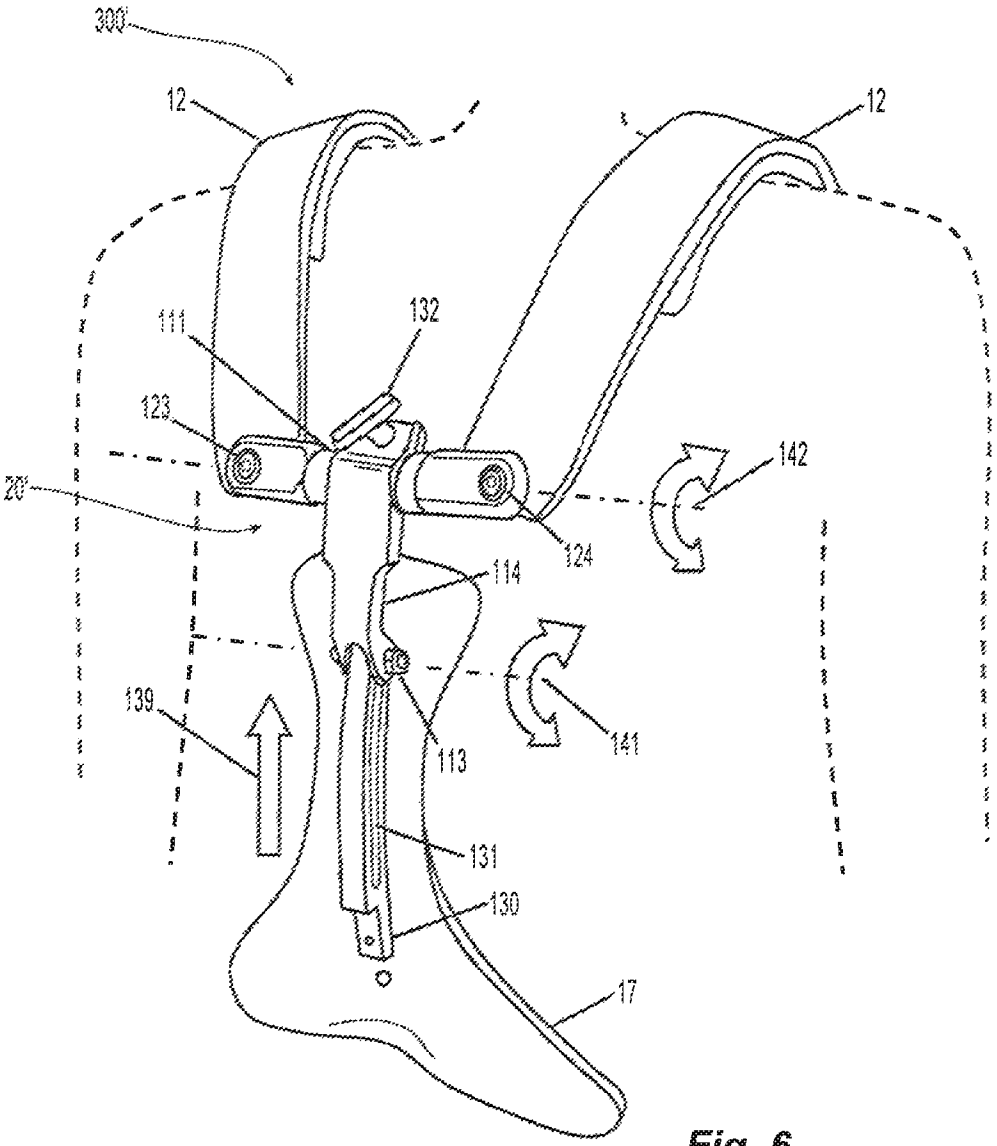
FIG. 6 shows a rear view of another contemplated embodiment of the articulating back member assembly with a sliding quick release feature with the back member in a bottom position.

FIG. 6 shows a rear view of the conforming and articulating back member assembly as a contemplated variation of the embodiment shown in FIG. 4. In particular, in this embodiment, the articulating back member assembly 20' has a sliding quick release feature with the back member 17 in a bottom position. The back member 17 is secured to a spine 130 where the spine 130 has a slot 131. The slot 131 allows the back member 17 to slide 139 on the shaft of the bolt 113. The slot 131 allows the back member 17 to slide up 139 and down 138 on the bolt 113. FIG. 7 shows the embodiment from FIG. 6 with the back member 17 in a top position.

When a user places the carrier 300' over his or her head, the back member 17 will slide to the upper position (as shown in FIG. 7) to pivot over the head. As the carrier 300' fits over the shoulders, the back member 17 will slide down into the lower position (as shown in FIG. 6) to align with the back of the user. Upon removal of the carrier 300', the back member 17 is free to pivot 141 to clear the back and head of the user as the carrier is lifted over the user's head. The locking screw 132 can set the position 142 of the arm 114.

Figure 8:
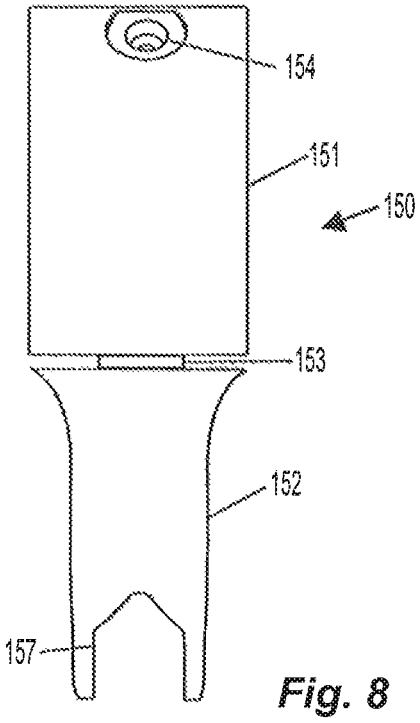
FIG. 8 is a plan view of a pivoting connection member.
Figure 9:
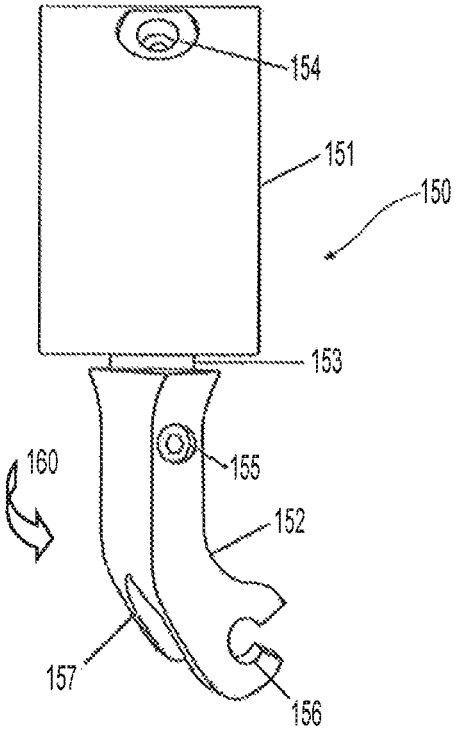
FIG. 9 shows the pivoting connection member with the lower twist member rotated.

FIG. 8 is a plan view of a pivoting connection member 150 and FIG. 9 shows the pivoting connection member 150 with the lower twist member 152 rotated. The upper portion of an upper twist member 151 has a hole 154 that secures a rod 158 (shown in FIG. 10) to adjust a distance between the upper and lower twist members 151, 152. The lower twist member 152 is secured with a fastening means such as a bolt 155. A rotating joint 153 allows the lower twist member 152 to turn 160 on the pivoting connection member 150. The lower twist member 152 has a split opening 157 to provide clearance for the spine 130 (shown in FIGS. 6, 7, 10). Another fastener secures the lower twist member 152 through opening 156 and through the slot 131.

Figure 10:
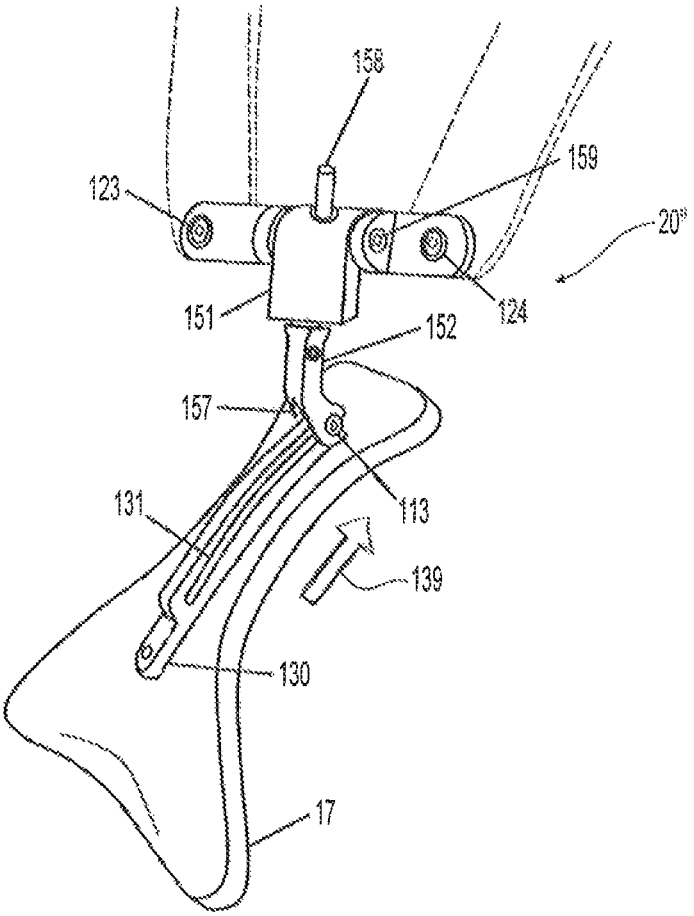
FIG. 10 shows a rear view of another contemplated embodiment of the articulating back member assembly with a sliding quick release feature with the back member in a bottom position in a turned orientation.

FIG. 10 shows a rear view of another contemplated embodiment of the articulating back member assembly 20" with a sliding quick release feature with the back member 17 in a bottom position in a turned orientation. In this embodiment, the back member 17 is secured to a spine 130 where the spine 130 has a slot 131. The slot 131 allows the back member 17 to slide 139 on the shaft of bolt 113. The slot 131 allows the back member 17 to slide on the bolt 113. A rod 158 to adjust a distance between the upper twist member 151 and the lower twist member 152. The clearance slot 157 allows the spine 130 to move and swing. The upper twist member 151 is secured to the carrier with a fastener 159. The upper twist member 151 is secured, via additional fasteners 123, 124, to the shoulder supports. The lower twist member 152 rotates or turns on the upper twist member 151 to allow the back member 17 to swing around the head and back of the user.

When a user places the carrier over his or her head, the back member 17 will rotate and slide to the upper position to pivot over the head. As the carrier fits over the shoulders, the back member 17 will slide down into the lower position to align with the back of the user. Upon removal of the carrier, the back member 17 is free to pivot to clear the back and head of the user as the carrier is lifted over the user's head. Once the back member 17 slides into the upper position, rotation is minimized.

FIGS. 11A-C illustrate exploded views according to several embodiments of the described invention, as applied to various carrier designs. Applicant submits the following explanations of the various acronyms in the figures—to be considered in light of the above more detailed descriptions of features and elements:

- ABSR/ABSL: shoulder supports (right/left, respectively).
- ABS: articulating back member.
- ABSB: articulating back member fastener bolts.
- ARS: auto-release slider, which accepts the ABHB therewithin so as to permit the ABHB to slide within and thereby permit repositioning of the ABSR/ABSL over the user's head for mount and dismount of the carrier.
- AA-AR: articulating arm.
- ABHB: articulating back hinge bolt, which is positioned through the ARS so as to slide with respect thereto and thereby reposition ABSR/ABSR over the user's head for mount and dismount of the carrier.
- ABAR/ABAL: articulating back axle (right/left, respectively)
- ABT: articulating back T-bolt, which locks the desired degree of rotation with the AA-AR.
- ABAB: bolts fastening ABAR and ABAL together.
- AB1: fasteners connecting the complete ABS to the AB SR/ABSL.

FIGS. 12A-B illustrate at least one embodiment in which a magnet coupling 200 is formed between a spine magnet 200A and an arm magnet 200B. As illustrated in FIG. 12A, the arm magnet 200B is located at a distal end of the arm 114, proximal to the bolt 113 that slides with respect to the slot 131 (see e.g., FIG. 10). The spine magnet 200A is located at a distal end of the spine 130, proximal to the distal end of the slot 131. Thus, the arm magnet 200B and the spine magnet 200A are configured to come into proximity to each other when the back member 17 is in a raised attitude (or raised position). As discussed above, the back member 17 is configured, via the bolt 113 and slot 131 configuration, to be pivotable about the bolt 113. Thus, the arm magnet 200B and the spine magnet 200A are further configured, as a result of such pivoting while the back member 17 is in the raised attitude, to come into magnetic contact with each other—thereby forming the magnetic coupling, which holds the back member 17 in the pivoted and raised attitude.

FIGS. 13A-D illustrate further views of the at least one embodiment illustrated in FIGS. 12A-B. While specific elements are not numerically called out in particular, corresponding elements in previously described embodiments will be apparent to one of ordinary skill in the art from the figures alone.

FIGS. 14A-D illustrate an exemplary method for operating at least one embodiment of the articulating back member having the feature of the magnetic coupling 200 discussed above. At step 2200 shown in FIG. 14A, a user positions the spine and arm magnets 200A, 200B into magnetic contact with each other to form the magnetic coupling 200 such that the back member 17 is held in the pivoted and raised attitude.

Figure 14A:
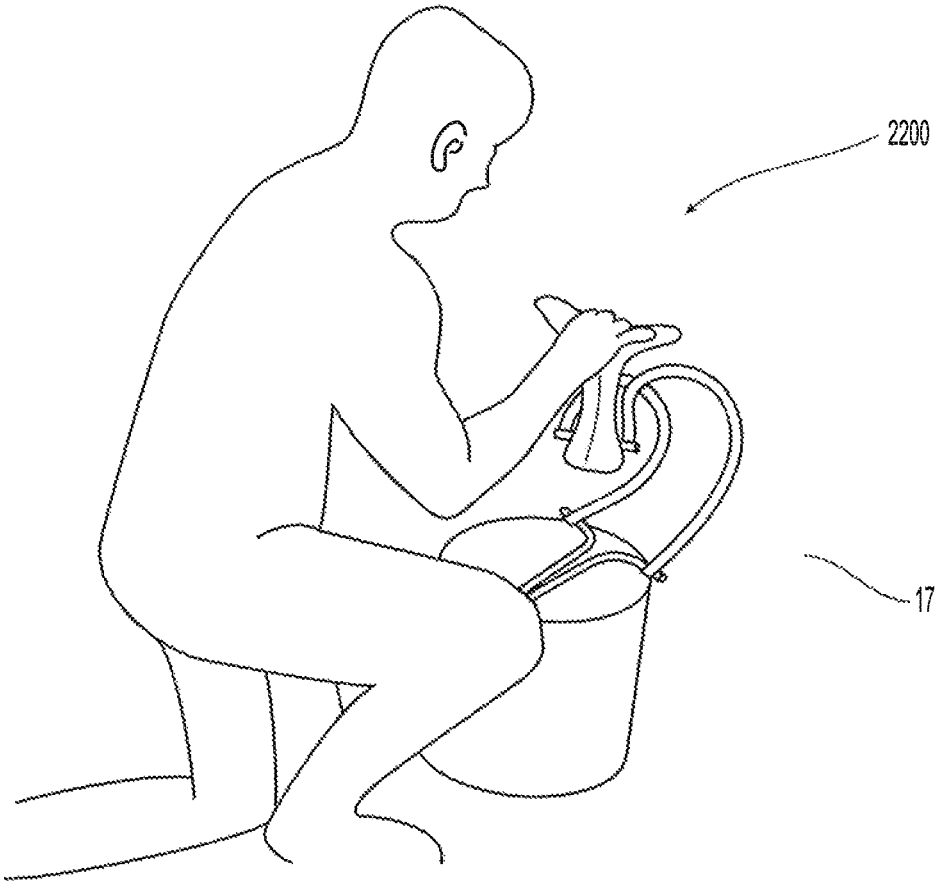
Figure 14B:
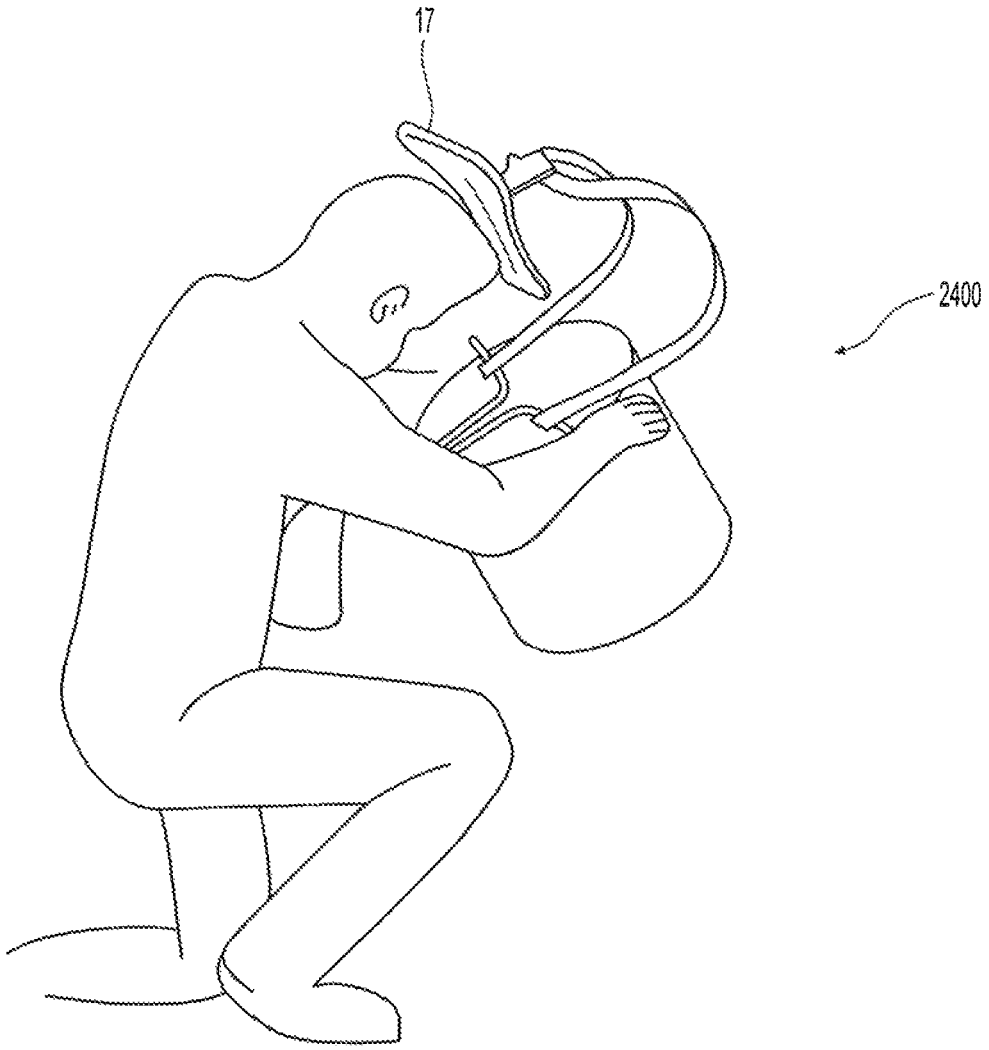

At step 2400 shown in FIG. 14B, the user begins to bring the shoulder straps (or shoulder supports) of the carrier to rest on his or her shoulders by raising the shoulder straps to be positioned over his or her head. The back member 17, at the same time, is positioned to come into contact with the user at the upper shoulder area and thereby disengage the magnetic coupling 200, allowing the back member 17 to slide with respect to the shoulder straps via the slot 131 and bolt 113 arrangement.

Figure 14C:
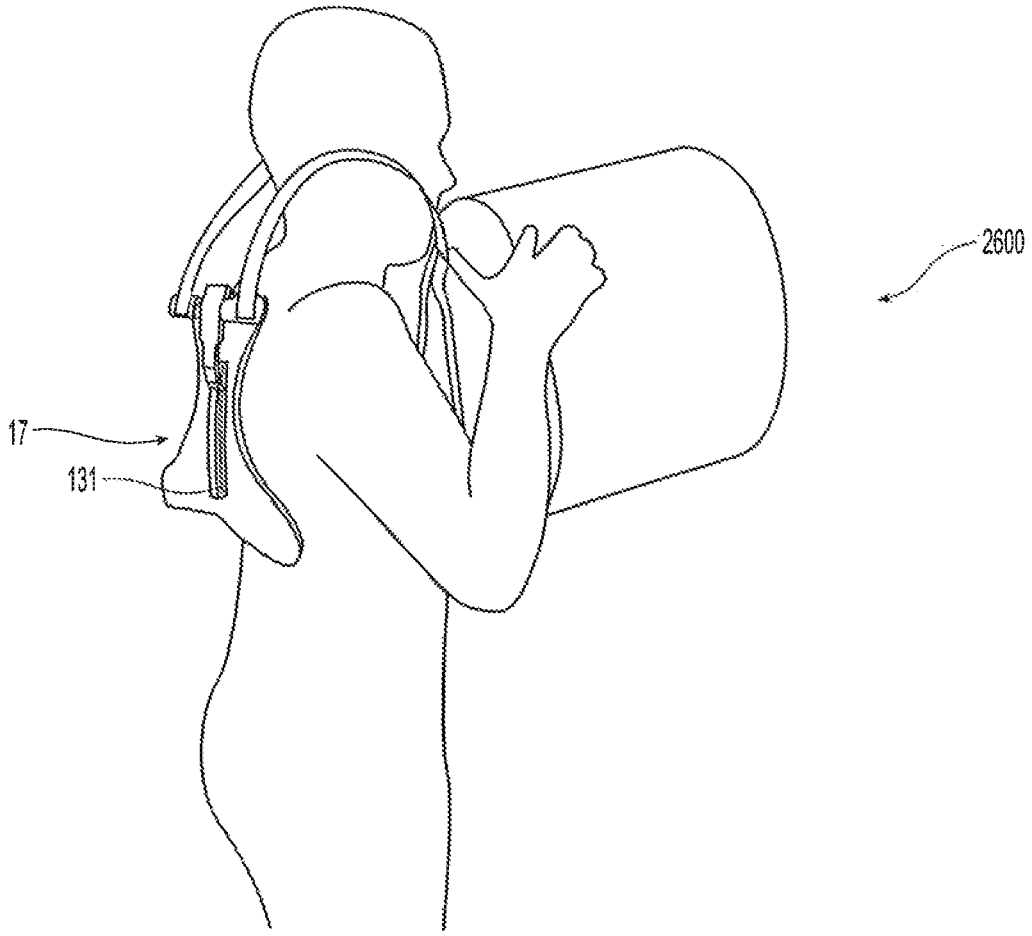

At step 2600 shown in FIG. 14C, the shoulder straps are positioned over the shoulders of the user, and the back member 17 is positioned against the upper back of the user in a lowered attitude with respect to the shoulder straps.

Figure 14D:
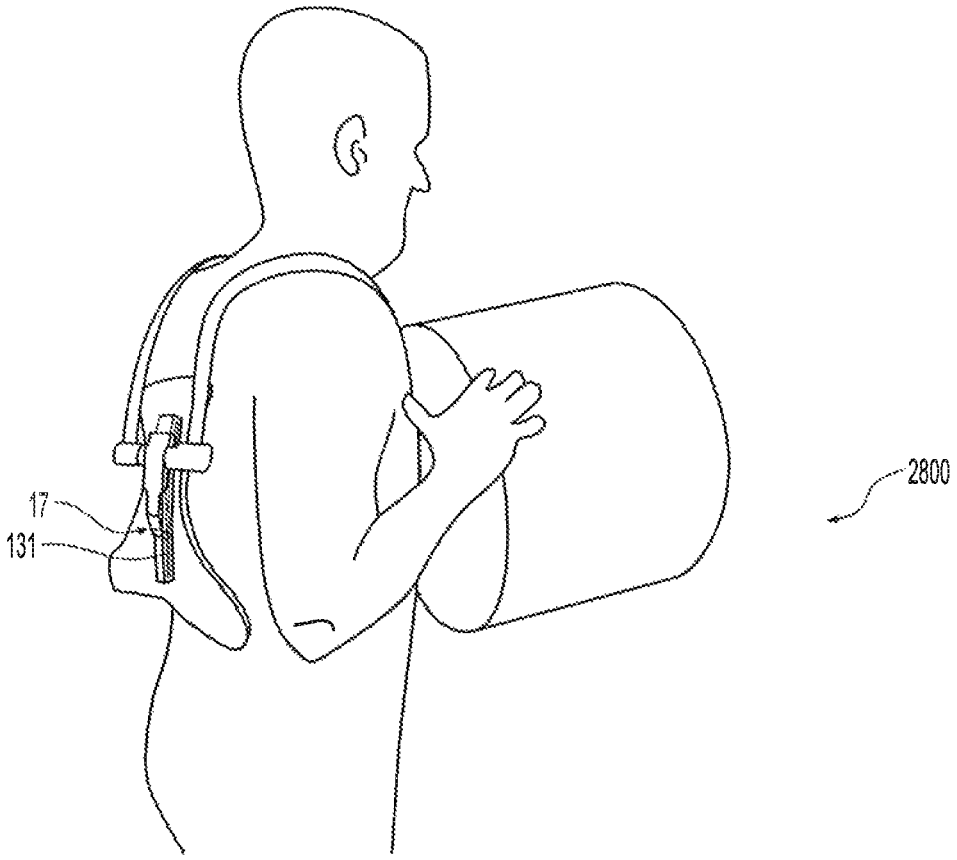

At step 2800 shown in FIG. 14D, the user lowers the shoulder straps to rest on his or her shoulders. The back member 17 at the same time slides, via the slot 131 and bolt 113 arrangement, with respect to the shoulder straps and thereby remains substantially in place with respect to the user's upper back.

The enablements described in detail above are considered novel over the prior art of record and are considered critical to the operation of at least one aspect of the invention and to the achievement of the above-described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that the named inventor believes that the claimed subject matter is what is intended to be patented.

The invention claimed is:

1. A shoulder supported harness assembly, comprising:
- a shoulder supported carrier structure;
- at least two shoulder supports for supporting the carrier structure on shoulders of a user;
- a back support for engaging a back of the user, the back support including:
  - a connecting member connecting the shoulder supports behind the user,
  - a back member having a spine with an elongated slot,
  - an arm pivotally coupled at a proximal end to the connecting member, and pivotally and slideably coupled to the back member at a distal end via the elongated slot of the spine.

2. The shoulder supported harness assembly of claim 1, wherein the connecting member is joined to the arm with a frictional connection.

3. The shoulder supported harness assembly of claim 1, wherein the arm is connected to the back member with a frictional connection.

4. The shoulder supported harness assembly of claim 1, wherein the back member at least partially contours to a shape of the back of said user.

5. The shoulder supported harness assembly of claim 1, wherein the elongated slot on the spine is curved.

6. The shoulder supported harness assembly of claim 1, wherein the back member is positionable between and under, or otherwise evades shoulder blades, of the user.

7. A back support for a shoulder supported harness assembly having at least two shoulder supports for supporting the harness assembly on shoulders of a user, the back support comprising:
- a connecting member connecting the shoulder supports behind the user,
- a back member for engaging a back of the user,
- an articulation mechanism coupling the connecting member and the back member such that the back member rotates and/or translates with respect to the shoulder supports so as to engage the back of the user.

8. The back support of claim 7, wherein the back member at least partially contours to a shape of said back of said user.

9. The back support of claim 7,
- wherein the back member includes a spine with an elongated slot, and
- wherein the articulation mechanism includes a pivot arm pivotally coupled at a proximal end to the connecting member, and pivotally and slideably coupled to the back member at a distal end via the elongated slot of the spine.

10. The back support of claim 7, wherein via the articulation mechanism the back member is slideable with respect to the shoulder supports.

11. The back support of claim 7, wherein the back member is positionable between and under, or otherwise evades shoulder blades, of said user.

12. The back support of claim 7, wherein the articulation mechanism permits the back member to be raised and/or lowered with respect to the connecting member.

13. The back support of claim 7, wherein the distance between ends of the shoulder supporting members is adjustable via the connecting member.

* * * * *